United States Patent [19]

Mizuno et al.

[11] 4,074,728

[45] Feb. 21, 1978

[54] APPARATUS FOR SELECTIVELY INSERTING WEFT YARNS INTO THE SHED OF A WEAVING LOOM

[75] Inventors: Yukio Mizuno, Kodaira; Takeshi Kikuchi, Mitaka; Shuichi Kojima, Tokyo, all of Japan

[73] Assignee: Nissan Motor Company, Limited, Japan

[21] Appl. No.: 728,540

[22] Filed: Oct. 1, 1976

[30] Foreign Application Priority Data

Oct. 5, 1975 Japan ..... 50-136162[U]

[51] Int. Cl.[2] ..... D03D 47/34

[52] U.S. Cl. ..... 139/435; 139/453

[58] Field of Search ..... 139/55.1, 66 R, 78, 139/80, 429, 435, 450, 453; 66/132, 133

[56] References Cited

U.S. PATENT DOCUMENTS 3,820,574 6/1974 Mizuno ..... 139/453

3,885,599 5/1975 Mawdsley et al. ..... 139/435

*Primary Examiner*—Henry S. Jaudon

*Attorney, Agent, or Firm*—Robert E. Burns; Emmanuel J. Lobato; Bruce L. Adams

[57] ABSTRACT

An apparatus for selectively inserting into the shed of a weaving loom a plurality of weft yarns having different natures, particularly colors, comprising cam means including at least one cam which is formed with lobe and bottom portions alternately arranged about the axis of rotation of the cam and which is driven to turn about the axis through a predetermined angle under the control of weft selector signal supply means such as a pattern card arrangement, wherein cam retaining means is provided to hold the cam in one of the angular positions operative to have each of the weft shooting members held in a position ready to insert the pick of weft yarn into the shed, the retaining means being disengaged from the cam when the cam is being rotated from one of the angular positions thereof into another.

9 Claims, 10 Drawing Figures

APPARATUS FOR SELECTIVELY INSERTING WEFT YARNS INTO THE SHED OF A WEAVING LOOM

BACKGROUND OF THE INVENTION

The present invention relates to weaving looms and more particularly to an apparatus for selectively inserting weft yarns into the shed in a weaving loom of the type which is capable of using a plurality of weft yarns having different natures, particularly colors. The weaving loom to which the present invention appertains is, furthermore, typically of the shuttleless type utilizing a jet stream of fluid for shooting the pick of weft yarn into the weaving shed, although the the present invention is applicable to any other type of weaving looms.

A representative example of the apparatus of the above described nature uses a cam unit including at least one lobular cam having lobe portions and bottom portions alternately arranged about the axis of rotation of the cam. The cam is driven to turn about the axis thereof under the control of suitable weft selector signal supply means such as for example a pattern card arrangement storing signals representative of a predetermined schedule in accordance with which a weft yarn to be inserted into the weaving shed is selected out of the weft yarns respectively detained in a plurality of weft shooting members or nozzles. A cam follower roller is in rolling contact with the cam surface of the cam and is operatively connected to the weft shooting nozzles by a suitable link mechanism so that any of the weft shooting nozzles is moved into a position ready to shoot into the weaving shed the pick of the weft yarn which has been detained therein as the cam follower roller is raised and lowered over the axis of rotation of the cam in each cycle of operation of the loom.

When the cam is rotated about the axis thereof from an angular position receiving the cam follower roller on one of its lobe portions into an angular position receiving the cam follower roller on one of its bottom portions, the cam follower roller is lowered over the axis of rotation of the cam. As the cam is thus moved closer to the latter angular position, the cam tends to be rotated at an increasing velocity about the axis thereof and is thus liable to turn beyond the angular position receiving the cam follower roller on one of its bottom portions. When, conversely, the cam is rotated from the angular position having an cam follower roller on one of its bottom portions into an angular position having the cam follower roller received on one of its cam lobe portions, the cam tends to turn at a decreasing velocity about the axis thereof and is thus liable to fail to accurately reach the angular position receiving the cam follower roller on one of its cam lobe portions. Such tendencies are pronounced when the cam is driven at an increased velocity.

SUMMARY OF THE INVENTION

A major object of the present invention is to provide the cam means of the above described general nature with such means that will eliminate the above mentioned tendencies and that are thus capable of reliably enabling the cam to turn from one of the aforesaid angular positions to another and to be retained in one of such positions when the cam is held at rest.

In accordance with the present invention, such an object is accomplished basically in an apparatus which comprises, in combination, a weft insertion unit including at least two weft shooting members each movable into a position aligned with the shed, weft selector cam means including at least one lobular cam rotatable about a fixed axis and formed with a plurality of cam lobe portions substantially equiangularly spaced apart from each other across bottom portions about the fixed axis and having substantially equal radii from the axis, the bottom portions having from the axis substantially equal radii smaller than the radii of the cam lobe portions, a link mechanism operatively connecting the cam to the weft insertion unit for moving one of the weft shooting members into the position aligned with the shed when engaging one of the cam lobe portions and another weft shooting member into the aforesaid position when engaging one of the bottom portions of the cam, cam actuating means operative to drive the cam to turn in a predetermined direction about the axis thereof from an angular position having one of its cam lobe portions engaged by the link mechanism into an angular position having one of its bottom portions engaged by the link mechanism or from the latter angular position into the former in each cycle of operation of the loom, weft selector signal supply means storing signals representative of a predetermined schedule in accordance with which the weft yarns are to be selectively inserted into the shed, locking means responsive to the signals delivered from the signal supply means for locking the cam actuating means in a condition inoperative to drive the cam in response to one signal from the signal supply means and releasing the cam actuating means from the inoperative condition in response to another signal from the signal supply means, and cam retaining means engageable with the cam means for holding the cam in any of the angular positions of the cam when the locking means is in locking engagement with the cam actuating means. The cam means may further comprise pins projecting from one end face of the cam substantially in parallel with the fixed axis of the cam and arranged substantially in symmetry about the axis, the number of the pins doubling the number of the lobe portions of the cam, the cam actuating means being engageable with the pins and movable with respect to the axis of the cam for turning each of the pins through an angle equal to to the central angle between every neighboring two of of the pins about the fixed axis and thereby driving the cam to rotate through the above mentioned angle about the aforesaid fixed axis in each cycle of operation provided the cam actuating means is disengaged from the locking means.

BRIEF DESCRIPTION OF THE DRAWINGS

The features and advantages of the apparatus according to the present invention will be more clearly understood from the following description taken in conjunction with the accompanying drawings in which like reference numerals and characters designate corresponding parts, elements and structures throughout the figures and in which.

DESCRIPTION OF THE PREFERRED EMBODIMENTS

Figure 1:
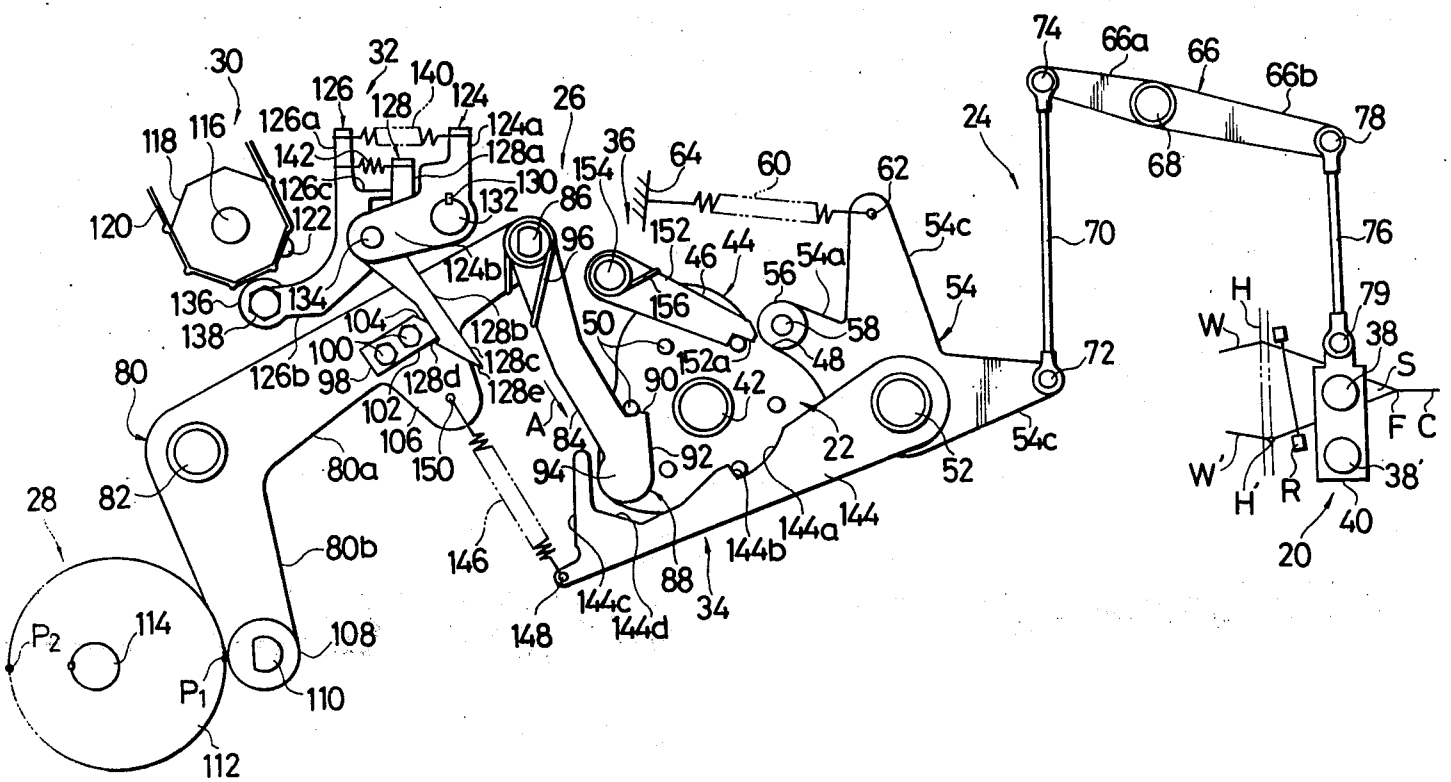
FIGS. 1 to 5 are schematic side elevations showing various operational conditions of a first preferred embodiment of the apparatus according to the present invention.

The constructions and operations of the embodiments of the apparatus according to the present invention will be hereinafter described with reference to the accompanying drawings. In the drawings, the majority of conventional parts and structures constructing a weaving loom into which each of the embodiments of the present invention is to be incorporated is omitted for the sake of clarity. The relative positions of the individual parts and structures constituting each embodiment in the loom will however be apparent to those skilled in the art from the directions in which the webs (designated by W and W') of warp yarns extend. The webs W and W' of warp yarns are alternately raised and lowered across a warp line L by means of weaving healds H and H', respectively, and form a shed S which is closed at the fell F of a woven cloth C. As is customary in the art, the warp line L is assumed to be substantially horizontal. Designated by R is a weaving reed which is adapted to hold the webs W and W' of warp yarns in position forming the shed S and to beat up the pick of a weft yarn (not shown) to the fell F of the woven cloth C after the pick of the weft yarn is shot into the shed S, as is well known in the art.

Referring to FIGS. 1 to 5 of the drawings, a first preferred embodiment of the present invention is shown largely comprising a weft insertion unit 20, a weft selector cam unit 22, a link mechanism 24 provided between the weft insertion unit 20 and the cam unit 22, cam actuating means 26 for actuating the cam unit 22 into various operational positions, intermittent-motion drive means 28 for driving the cam actuating means 26, a pattern card arrangement 30 serving as program-controlled weft selector signal supply means, locking means 32 locking and releasing the cam actuating means 26 in response to the signal delivered from the pattern card arrangement 30, and first and second cam retaining means 34 and 36 for securely holding the cam unit 22 in an angular position into which the cam unit is moved by the cam actuating means 26.

Figure 4:
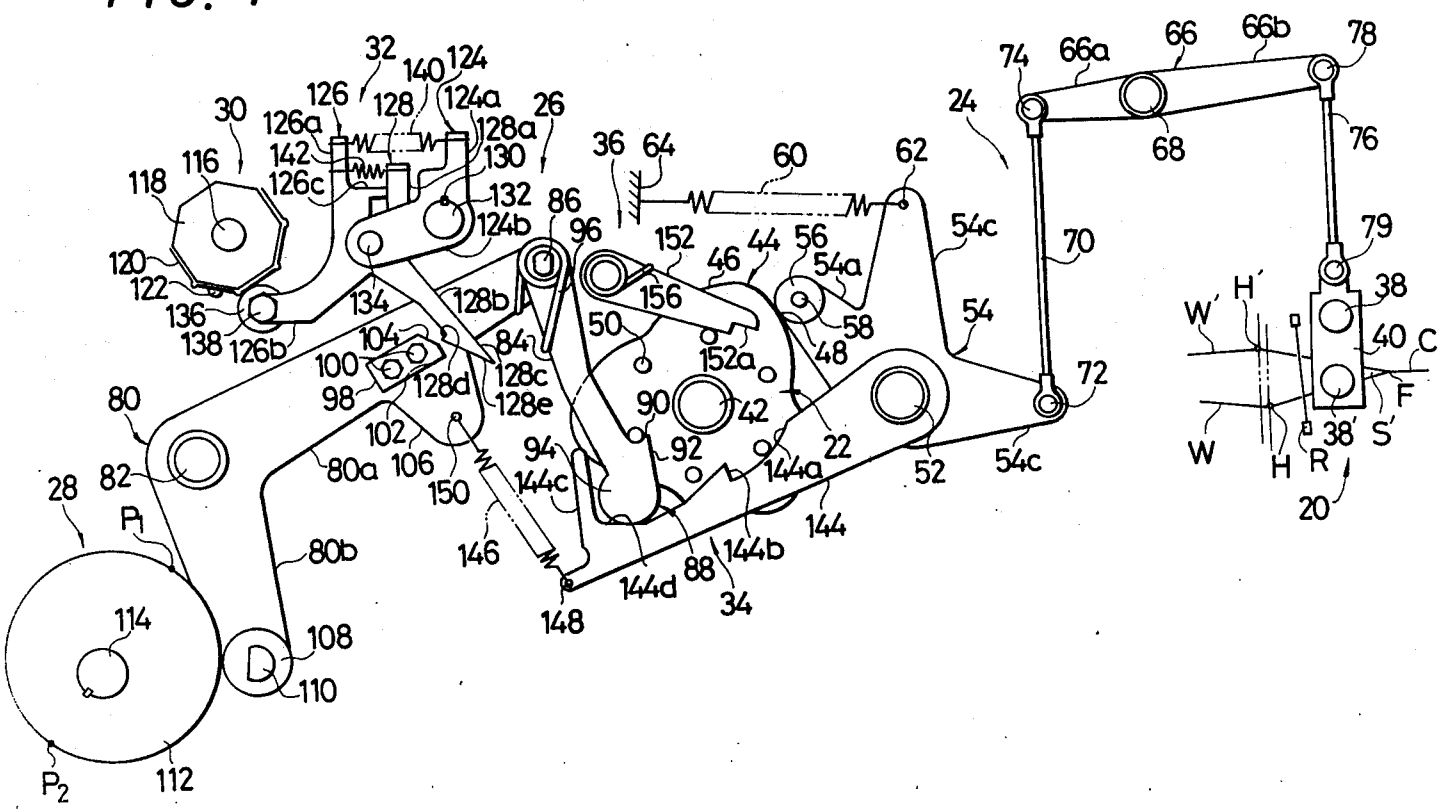
Figure 5:
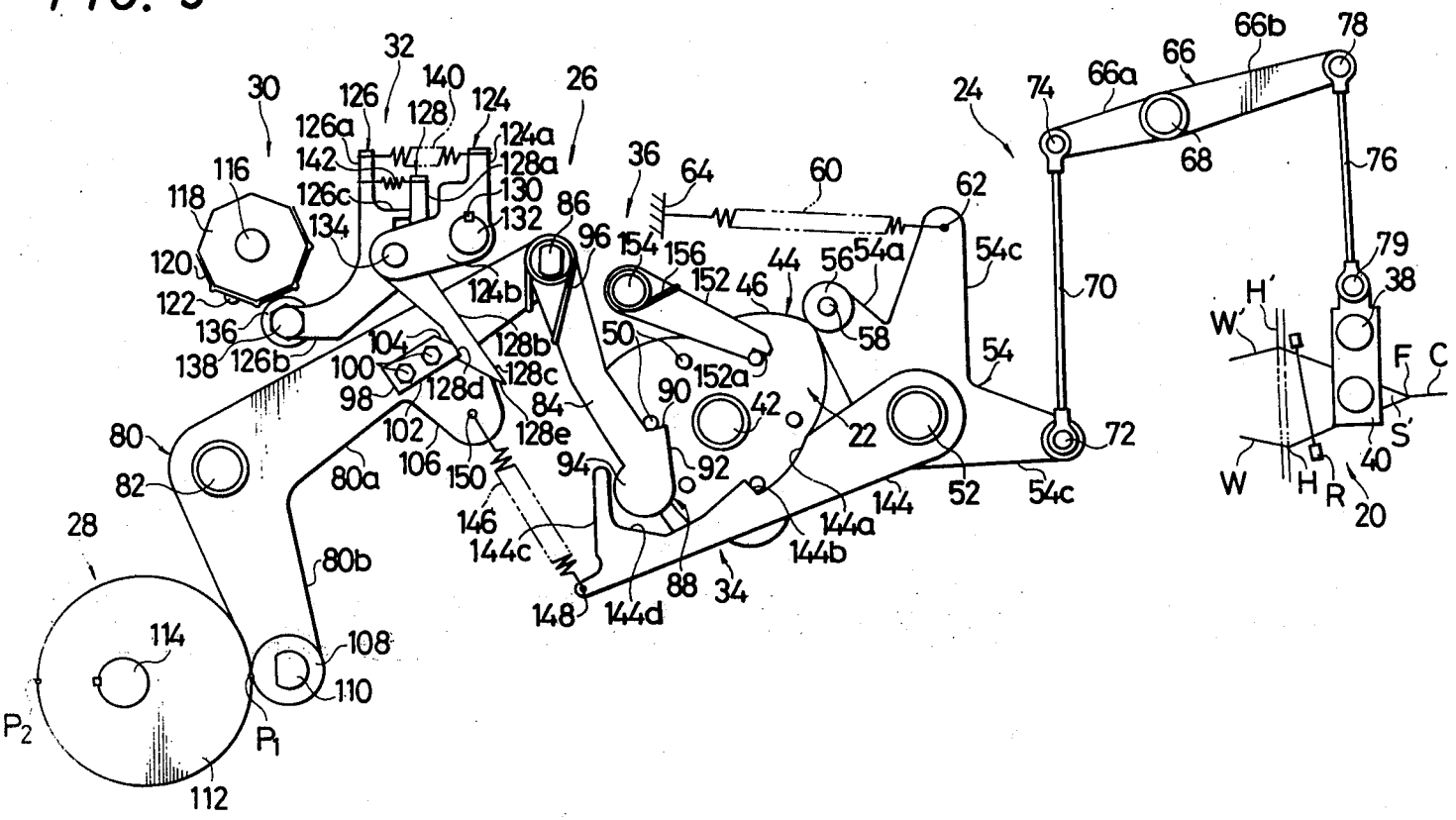

The embodiment of the apparatus according to the present invention as herein illustrated is assumed, by way of example, to be arranged to be capable of dealing with two weft yarns of different natures, particularly colors and, thus, the weft insertion unit 20 is shown comprising first and second weft shooting nozzles 38 and 38' mounted on a common nozzle carrier 40. The nozzle carrier 40 is vertically movable in close proximity to one lateral end of the weaving shed S between a lower first position having the first weft shooting nozzle 38 located to have its center axis aligned with the weaving shed S and flush with the warp line L as illustrated in FIG. 1 and an upper second position having the second weft shooting nozzle 38' located to have its center axis aligned with the weaving shed S and flush with the warp line L as illustrated in FIGS. 4 and 5. Each of the weft shooting nozzles 38 and 38' is adapted to detain therein a pick of weft yarn leading from a yarn supply package through a weft drawing and measuring arrangement (not shown) as is customary. Though not shown in the drawings, the nozzle carrier 40 has further mounted thereon a fluid feed duct leading from a source of fluid under pressure. When the nozzle carrier 40 is moved into the above mentioned first or second position thereof, communication is provided between the duct and one of the weft shooting nozzles 38 and 38' and the pick of the weft yarn which has been detained in the particular one of the nozzles is shot into the weaving shed S by the jet stream of fluid ejected from the nozzle.

On the other hand, the weft selector cam unit 22 comprises a fixed horizontal shaft 42 and a lobular cam 44 which is rotatable of the shaft 42 about the center axis of the shaft 42. The lobular cam 44 has a plurality of arcuate cam lobe portions 46 which have equal radii from the center axis of the shaft 42 and equal central angles about the axis of the shaft 42 and which are substantially equiangularly spaced apart from each other about the center axis of the shaft 42 across intermediate bottom portions 48 which also have equal radii from the center axis of the shaft 42. The cam lobe portions 46 of the cam 44 are assumed, by way of example, to be provided as three in number as illustrated in the drawings so that the vertices of the cam lobe portions 46 are angularly spaced apart 120° from each other about the center axis of the shaft 42, and, as a consequence, there is established a central angle of approximately 60° between the vertex of each of the cam lobe portions 46 and each of the bottom portions 48 into which the lobe portions 46 merge. It is, however, apparent that the number of the cam lobe portions 46 as above described is merely for the purpose of illustration and can be selected arbitarily without respect to the number of the weft yarns to be used.

The cam 44 is provided with pins 50 which project from one end face of the cam 44 substantially in parallel with the center axis of the shaft 42 and which are arranged substantially symmetrically about the center axis of the shaft 42. The pins 50 are provided in a number doubling the number of the lobe portions 46 of the cam 44 and are, thus, shown to be six in number because the cam 44 is assumed to have three lobe portions 46 as above described.

The link mechanism 24 provided between the above described weft insertion unit 20 and cam assembly 22 comprises a horizontal stationary shaft 52 having a center axis substantially parallel with the center axis of the above mentioned cam shaft 42. A bell crank lever 54 has an intermediate fulcrum portion rotatably mounted on the stationary shaft 52 and has first, second and third arm portions **54*a*, 54*b* and 54*c* extending from the fulcrum portion and angularly spaced apart from each other about the center axis of the shaft 52. The first arm portion 54*a* of the bell crank lever 54 has mounted at its leading end a cam follower roller 56 which is rotatable about the center axis of a pin 58 mounted on the arm portion 54*a* and having a center axis substantially parallel with the respective center axes of the shafts 42 and 52. The cam follower roller 56 is engageable with the cam 44 or, more specifically, rollable on one of the cam lobe portions 46 or one of the bottom portions 48 of the cam 44 depending upon the angular position of the cam 44 with respect to the bell crank lever 54 as will be described in more detail. The cam follower roller 56 is forced against the cam surface of the cam 44 by suitable biasing means operative to urge the bell crank lever 54 to turn counter-clockwise in the drawings, such biasing means being shown comprising a preloaded helical tension spring 60 which is anchored at one end to the third arm portion 54*c* of the bell crank lever 54 by a pin 62 and at the other end to a suitable stationary member or structure 64 which may be part of the loom construction. When the cam 44 is rotated about the center axis of the cam shaft 42, the cam follower roller 56 on the first arm portion 54*a* of the bell crank lever 54 is alternately raised and lowered over the cam shaft 42 and consequently the bell crank lever 54 is oscillated between clockwise and counter-clockwise extreme rotational positions, respectively, in the drawings about the center axis of the shaft 52 as the cam follower roller 56 is alternately brought into rolling contact with each of the cam lobe portions 46 and each of the bottom portions 48 of the cam 44. The counter-clockwise and clockwise extreme rotational positions of the bell crank lever 54 in the drawings are herein referred to as first and second angular positions, respectively, of the bell crank lever 54 about the center axis of the stationary shaft 52. As the bell crank lever 54 is rotated about the center axis of the shaft 52 toward the first and second angular positions, the second arm portion 54*b*** thereof has its leading end moved upwardly and downwardly, respectively.

The link mechsnism 24 further comprises a rocker 66 having an intermediate fulcrum portion rotatably mounted on a horizontal stationary shaft 68 having a center axis substantially parallel with the center axis of the shaft 52 carrying the bell crank lever 54. The rocker 66 has first and second arm portions **66*a* and 66*b* extending generally horizontally from the intermediate fulcrum portion of the rocker 66 and having respective leading ends located over the leading end of the second arm portion 54*b* of the bell crank lever 54 and the nozzle carrier 40 of the weft insertion unit 20, respectively, as shown. A generally vertical connecting rod 70 is pivotally connected at one end to the leading end of the second arm portion 54*b* of the bell crank lever 54 by a pivotal pin 72 and at the other end to the leading end of the first arm portion 66*a* of the rocker 66 by a pivotal pin 74. Likewise, a generally vertical connecting rod 76 is pivotally connected at one end to the leading end of the second arm portion 66*b* of the rocker 66 by a pivotal pin 78 and at the other end to the nozzle carrier 40 of the weft insertion unit 20 by a pivotal pin 78. When, thus, the bell crank lever 54 is rotated into the previously mentioned first and second angular positions, viz., the counter-clockwise and clockwise extreme rotational positions thereof in the drawings about the center axis of the shaft 52 and has the leading end of its second arm portion 54*b* moved into the uppermost and lowermost positions, the rocker 66 is driven to turn clockwise and counter-clockwise, respectively, in the drawings about the center axis of the shaft 68 so that the nozzle carrier 40 is moved into the lower first and upper second positions, respectively. The first and second weft shooting nozzles 38 and 38' are thus moved into the positions aligned with the weaving shed S when the bell crank lever 54 is moved into the first and second angular positions, respectively, thereof about the center axis of the shaft 52**.

Figure 2:
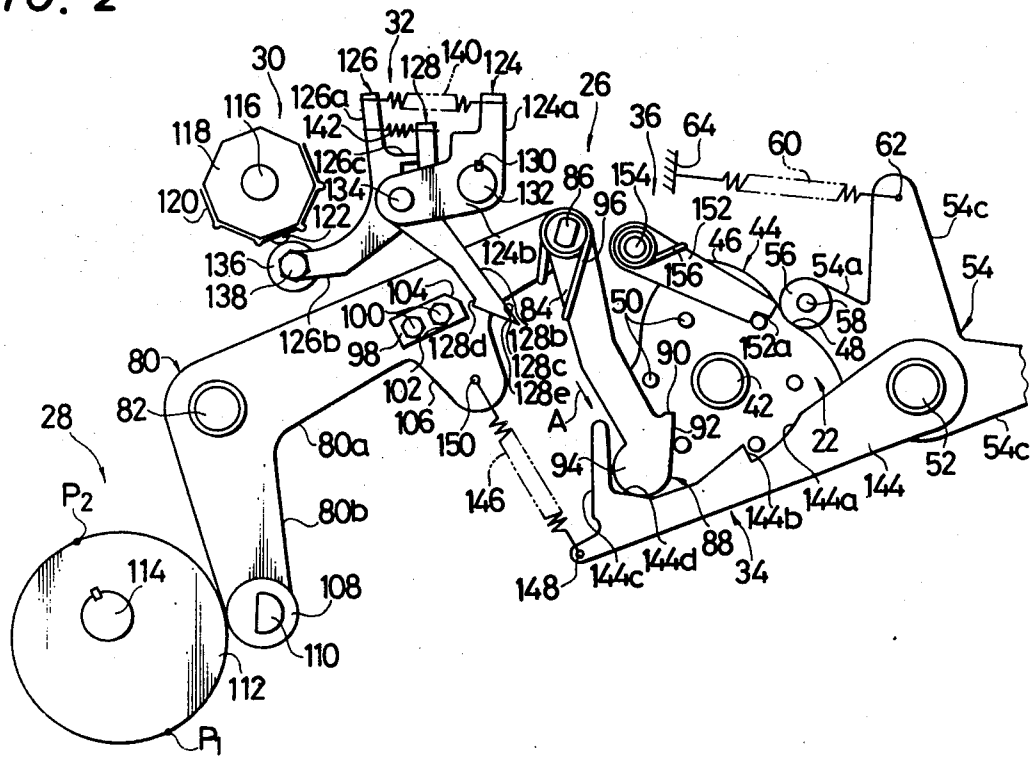

On the other hand, the cam actuating means 26 comprises a bell crank lever 80 having an intermediate fulcrum portion rotatably mounted on a horizontal stationary shaft 82 having a center axis which is substantially parallel with the center axis of the cam shaft 42. The bell crank lever 80 has first and second arm portions **80*a* and 80*b* extending generally upwardly and downwardly, respectively, from the fulcrum portion of the bell crank lever and angularly spaced apart from each other about the center axis of the shaft 82. The bell crank lever 80 has supported at the leading end of its first arm portion 80*a* an elongated cam actuating member 84 by a pivotal pin 86 having a center axis which is substantially parallel with the respective center axes of the shafts 42 and 82. The cam actuating member 84 is thus rotatable on the first arm portion 80*a* of the bell crank lever 80 about the center axis of the pivotal pin 86 and is movable, together with the bell crank lever 80, relative to the cam shaft 42 on a vertical plane perpendicular to the center axes of the shafts 42 and 82 and in the direction of arrow A, viz., generally downwardly and sidewise to the cam shaft 42 from an uppermost position shown in FIG. 1 to a lowermost position shown in FIG. 3. The cam actuating member 84 extends generally downwardly away from the pivotal pin 86 and has a lowermost hook portion 88 formed with a notch 90 facing the pivotal pin 86, a guide surface 92 slanting from the lower end of the hook portion 88 and terminating at the notch 90, and a rounded projection 94 opposite to the guide surface 92. The notch 90 and guide surface 92 of the hook portion 88 are located and movable in the circular path of the pins 50 on the cam 44 about the center axis of the cam shaft 42 so that the hook portion 88 is capable of receiving one of the pins 50 either in the notch 90 as shown in FIG. 1 or on the guide surface 92 as shown in FIG. 2 depending upon the relative angular positions of the cam 44 and the cam actuating member 84 about the center axes of the cam shaft 42 and the pivotal pin 86, respectovely. The projection 94 of the hook portion 88 protrudes generally perpendicularly away from the cam shaft 44. The cam actuating member 84 thus configured is urged to turn counter-clockwise in the drawings about the center axis of the pivotal pin 86 and accordingly has the hook portion 88 biased toward the cam shaft 42 by suitable biasing means such as a helical torsion spring 96 which is wound up around the pivotal pin 86 and which has one end portion clamped on the first arm portion 80*a* of the bell crank lever 80 and the other end portion clamped on the upper end portion of the cam actuating member 84** as shown.

The bell crank lever 80 has a land 98 fixedly mounted on one face of the first arm portion **80*a* thereof by suitable fastening means such as bolts 100. The land 98 has a substantially flat surface portion 102 which is found on or may be slightly inclined to or deviated from a plane passing through the center axis of the stationary shaft 82 carrying the bell crank lever 80. The land 98 is further formed with a guide surface portion 104 which is inclined to the above mentioned surface portion 102. For the reason which will be understood as the description proceeds, the first arm portion 80*a* of the bell crank lever 80 is formed with a projection 106 which is directed generally downwardly from the arm portion 80*a* as illustrated. The bell crank lever 80 has further mounted at the leading end of its second arm portion 80*b* a roller 108 which is rotatable on a shaft 110 secured to the arm portion and having a center axis which is substantially parallel with the center axis of the stationary shaft 82 on which the bell crank lever 80** is mounted.

The intermittent-motion drive means 28 comprises an eccentric cam 112 securely mounted on a rotatable cam shaft 114 having a horizontal center axis substantially parallel with the center axis of the shaft 82 carrying the bell crank lever 80. The eccentric cam 112 has higher and lower semicircular lobe portions having respective vertices $P_1$ and $P_2$ which are diametrically opposed to each other across the center axis of the cam shaft 114. The cam shaft 114 is operatively connected to a drive source through suitable torque transmission means such as gear arrangement though not shown in the drawings and is driven to rotate about the center axis of the cam shaft 114 at a velocity which is synchronized with the velocities at which other rotatable or otherwise movable members and structures of the loom are driven. The eccentric cam 112 is herein assumed to be driven to make a full turn about the axis of the shaft 114 per weaving cycle of the loom, by way of example. The roller 108 on the second arm portion 80*b* of the above described bell crank lever 80 is engageable with the cam 112 and is thus rollable alternately on the higher and lower lobe portions of the cam 112 depending upon the angular position of the cam 112 about the center axis of the cam shaft 114 relative to the bell crank lever 80. The roller 108 on the bell crank lever 80 thus serves as a cam follower for the eccentric cam 112. When the eccentric cam 112 is rotated about the center axis of the cam shaft 114 with its higher and lower lobe portions alternately brought into rolling contact with the cam follower roller 108 on the bell crank lever 80, the cam follower roller 108 is alternately raised and lowered over the cam shaft 114 so that the bell crank lever 80 is caused to oscillate between counter-clockwise and clockwise extreme rotational positions shown in FIGS. 1 and 3, respectively, about the center axis of the stationary shaft 82. The clockwise and counter-clockwise extreme rotational positions of the bell crank lever 80 are herein referred to as first and second limit angular positions, respectively, of the bell crank lever 80 about the center axis of the shaft 82. When the bell crank lever 80 is thus oscillated between the first and second angular positions about the axis of the shaft 82, the pivotal pin 86 at the leading end of the first arm portion 80*a* of the bell crank lever 80 is moved in an arc generally toward and away from the cam shaft 42 carrying the lobular cam 44. This causes the cam actuating member 84 to move generally upwardly and downwardly sidewise to the cam shaft 42 so that the hook portion 88 of the cam actuating member 84 is moved in the path of the pins 50 on the lobular cam 44 and drives the cam 44 to turn clockwise in the drawings about the center axis of the cam shaft 42 through engagement between the notch 90 of the hook portion 88 of the cam actuating member 84 and one of the pins 50 on the cam 48, as will be described more clearly.

The pattern card arrangement 30 as the weft selector signal supply means comprises a shaft 116 having a center axis substantially parallel with the center axis of the shaft 82 carrying the bell crank lever 80, a sprocket wheel 118 rotatable about the center axis of the shaft 116 and having a suitable number of teeth or guide faces, an endless chain 120 passed on the sprocket wheel 118 and a peg 122 mounted on predetermined one of the guide faces of the sprocket wheel 118. The sprocket wheel 118 is operatively connected to the previously mentioned driving source through suitable torque transmission means such as gear arrangement though not shown in the drawings and is driven to turn about the center axis of the shaft 116 at a velocity related to the rotational velocity of the cam shaft 114 carrying the eccentric cam 112. For the purpose of description, the sprocket wheel 118 is herein assumed to have eight guide faces and to be driven to make a one-eighth turn about the center axis of the shaft 116 per full turn of the eccentric cam 112 about the center axis of the cam shaft 114.

The locking means 32 is adapted to lock the previously described bell crank lever 80 and accordingly the cam actuating member 84 in response to the signal delivered from the above described pattern card arrangement 30. The locking means 32 in its entirety is located in conjuction with the cam actuating means 26 and the pattern card arrangement 30 and largely comprises a stationary support member 124, a rocking member 126 and a clamping member 128. The support member 124 is fixedly mounted by means of a key 130 on a horizontal stationary shaft 132 having a center axis substantially parallel with the center of the shafts 116 and 82 of the pattern card arrangement 30 and the bell crank lever 80 and has an upper first arm portion 124*a* directed upwardly from the shaft 132 and a lower second arm portion 124*b* directed generally downwardly sidewise to the shaft 132. The support member 124 has mounted at the leading end of its second arm portion 124*b* a pivotal pin 134 having a center axis substantially parallel with the center axis of the shaft 132. The rocking and clamping members 126 and 128 have respective intermediate fulcrum portions rotatably mounted on the pivotal pin 134 and are rotatable independently of each other about the center axis of the pin 134. The support member 124, rocking member 126 and clamping member 128 are positioned relative to each other in such a manner that the clamping member 128 is interposed between the support member 124 and rocking member 126 and has one face thereof in slidable contact with the support member 124 and the other face thereof in slidable contact with the rocking member 126. The rocking member 126 has an upper first arm portion 126*a* extending upwardly from the fulcrum portion of the member 126, a lower second arm portion 126*b* extending generally downwardly sidewise to the pivotal pin 134 from the fulcrum portion, and a land or projection 126*c* formed on the upper first arm portion 126*a*. The lower second arm portion 126*b* has its leading end located and movable in proximity to the sprocket wheel 118 of the pattern card arrangement 30 and has mounted thereat a roller 136 which is rotatable on a shaft 138 mounted on the arm portion 126*b* and having a center axis substantially parallel with the center axes of the shaft 116 of the pattern card arrangement 30 and the shaft 134 supporting the support member 124. The rocking member 126 as a whole is urged to turn clockwise in the drawings about the center axis of the pivotal pin 134 and thus has the roller 136 forced onto the sprocket wheel 118 of the pattern card arrangement 30 by suitable biasing means such as a preloaded helical tension spring 140 which is anchored at one end to the upper first arm portion 124*a* of the support member 124 and at the other end to the upper first arm portion 126*a* of the rocking member 126. The rocking member 126 is thus rotatable about the center axis of the pivotal pin 134 between an upright first angular position and an inclined second angular position rotated counter-clockwise in the drawings against the force of the tension spring 140 as the roller 136 on the rocking member 126 rolls on the sprocket wheel 118 of the pattern card arrangement 30. On the other hand, the clamping member 128 has an upper first arm portion 128*a* extending upwardly from the fulcrum portion of the clamping member and a lower second arm portion 128*b* extending from the fulcrum portion generally downwardly sidewise to the center axis of the pivotal pin 134. The lower second arm portion 128*b* of the clamping member 128 has a latch portion 128*c* which is formed with an edge 128*d* facing the fulcrum portion of the clamping member and with a guide surface 128*e* slanting from the lower end of the latch portion 128*c* and terminating at the above mentioned edge 128*d*. The edge 128*d* of the latch portion 128*c* is engageable in a surface-to-surface fashion with the previously mentioned surface portion 102 of the land 98 on the bell crank lever 80 and, furthermore, the guide surface **128*e* of the latch portion 128*c* is slidable on the previously mentioned guide surface portion 104 of the land 98 depending upon the angular positions of the bell crank lever 80 and the clamping member 128 about the center axes of the shaft 82 and the pivotal pin 82, respectively. The previously mentioned projection 126*c* of the upper first arm portion 126*c* of the rocking member 126 is configured in such a manner as to be engageable with the upper first arm portion 128*a* of the clamping member 128 which is positioned in side-by-side relationship to the rocking member 126. The clamping member 128 is urged to turn about the center axis of the pivotal pin 134 counter-clockwise of the drawings relative to the rocking member 126 by suitable biasing means such as a preloaded hilical tension spring 142 which is anchored at one end to the upper first arm portion 126*a* of the rocking member 126 and at the other end to the upper first arm portion 128*a* of the clamping member 128. For the purpose of having the springs 140 and 142 securely anchored to the members to which the springs are connected, each of the members 126, 128 and 130** may be formed with a notch or notches.

On the other hand, the previously mentioned first cam retaining means 34 comprises an elongated lever 144 having one end portion rotatably mounted on the stationary shaft 52 supporting the bell crank lever 54 of the previously described link mechanism 24. The lever 144 has an intermediate portion which is located and movable in proximity to the lower end of the lobular cam 44 and which formed with a notch or recess located and movable in the circular path of the pins 50 on the cam 44. The notch or recess in the lever 144 is defined partly by a guide surface portion **144*a* facing the cam shaft 42 and slanting radially outwardly with respect to the direction of movement of the pins 50 on the cam 44 and a lateral edge portion 144*b* at which the guide surface portion 144*a* terminates. The guide surface portion 144*a* and the lateral edge portion 144*b* are shaped and located to be capable of receiving on either of them any one of the pins 50 depending upon the relative angular positions of the cam 44 and the lever 144 about the center axes of the cam shaft 42 and the shaft 52, respectively. When one of the pins 50 on the cam 50 is received on the lateral edge portion 144*b* of the lever 144 as shown in FIG. 1, the cam 44 is prevented from rotating clockwise of the drawings about the center axis of the cam shaft 42. The lever 144 has a leading end portion located below the hook portion 92 of the previously described cam actuating member 84 and has formed on the leading end portion a projection 144*c* extending upwardly from the leading end portion. The projection 144*c* is angularly spaced apart from the intermediate portion of the lever 144 and has formed therebetween a curved notch portion 144*d* which is shaped and located to be engageable with the rounded projection 94 of the hook portion 88 of the cam actuating member 84 depending upon the relative angular positions of the cam actuating member 84 and the lever 144 about the center axis of the shaft 82 carrying the bell crank lever 80 and the center axis of the shaft 52 carrying the lever 144, respectively. The lever 144 thus configured and arranged is urged to turn about the center axis of the shaft 52 clockwise of the drawings, viz., toward the center axis of the cam shaft 42 by suitable biasing means connected between the lever 144 and the bell crank lever 80 of the cam actuating means 26, the biasing means being shown comprising a preloaded helical tension spring 146 which is anchored at one end to the leading end of the lever 144 by a spring retaining pin 148 and at the other end to the previously mentioned projection 106 of the upper first arm portion 80*a* of the bell crank lever 80 by a spring retaining pin 150. The tension spring 146 is, thus, operative not only to urge the lever 144 clockwise of the drawings but to urge the bell crank lever 80 to turn clockwise of the drawings about the center axis of the shaft 82 so that the cam follower roller 108 mounted on the lower second arm portion 80*b* of the bell crank lever 80 is forced against the cam surface of the eccentric cam 112. If desired, the biasing means thus interconnecting the bell crank lever 80 and the lever 144 may be replaced with separate springs respectively connected to the bell crank lever 80 and the lever 144**, though not shown in the drawings.

While the first cam retaining means 34 is thus adapted to prevent clockwise rotation of the lobular cam 44 about the center axis of the cam shaft 42 when engagement is established between the lever 144 and one of the pins 50 on the cam 44, the second cam retaining means 36 is arranged to prevent the lobular cam 44 from turning in the opposite direction about the center axis of the cam shaft 42. The second cam retaining means 52 comprises a lever 152 which is rotatable on a stationary shaft 154 having a center axis substantially parallel with the center axis of the cam shaft 42. The lever 152 has a leading end portion located and movable in proximity to the upper end of the rotational position of the lobular cam 44 and has a notch **152*a* formed in the leading end portion. The notch 152*a* is located and movable in the circular path of the pins 50 on the cam 44 and is thus capable of receiving therein any one of the pins 50 depending upon the relative angular positions of the cam 44 and the lever 152 about the center axes of the cam shaft 42 and the shaft 154, respectively. When, thus, one of the pins 50 on the cam 44 is captured in the notch 152*a* of the lever 152 as shown in FIG. 1, the cam 44 is prevented from rotating counter-clockwise of the drawings about the center axis of the cam shaft 42. The lever 152 is urged to turn clockwise of the drawings by suitable biasing means such as a preloaded helical torsion spring 156 which has one end portion securely wound up on the shaft 154 and the other end portion clamped to the lever 152** as illustrated.

The operation of the embodiment of the present invention thus constructed and arranged will be hereinafter described with reference to FIGS. 1 to 5.

Throughout the operation of the apparatus, the eccentric cam 112 of the intermittent-motion drive means 28 is kept driven to rotate about the center axis of the cam shaft 114 at a fixed velocity related to the velocities at which the other rotatable and otherwise movable members and structures of the loom are driven, as previously mentioned. The rotation of the eccentric cam 112 is transmitted to the shaft 116 of the pattern card arrangement 30 and drives the sprocket wheel 118 to rotate about the center axis of the shaft 116 at a velocity equal to one eighth of the rotational velocity of the eccentric cam 112 as also mentioned previously. The sprocket wheel 118 therefore makes a one-eighth turn about the center axis of the shaft 116 and accordingly the individual guide faces of sprocket wheel 118 are brought into contact with the roller 124 on the rocking member 114 of the locking means 32 one after another as the eccentric cam 112 makes a full turn about the center axis of the cam shaft 114.

When the eccentric cam 112 is thus driven for rotation about the center axis of the cam shaft 114 and has its higher and lower cam lobe portions alternately brought into rolling contact at their respective vertices $P_1$ and $P_2$ with the cam follower roller 124 on the bell crank lever 80, the cam follower roller 108 is alternately raised and lowered over the cam shaft 114 so that the bell crank lever 80 carrying the cam follower roller 108 is caused to oscillate between the previously mentioned first and second angular positions thereof about the center axis of the stationary shaft 82 on which the bell crank lever 80 is mounted. If, under these conditions, the sprocket wheel 118 of the pattern card arrangement 30 happens to have an angular position having one of its guide faces in contact with the roller 136 on the rocking member 126 of the locking means 32, the rocking member 126 is held in the previously mentioned upright first angular position thereof about the center axis of the pivotal pin 134 on the support member 124 by the force of the tension spring 140, as illustrated in FIG. 1. When the rocking member 126 assumes the first angular position as above described, the clamping member 128 has its upper first arm portion **128*a* held in contact with the projection 126*c* of the upper first arm portion 126*a* of the rocking member 126 and has about the center axis of the pivotal pin 134 an angular position having the edge 128*a* of its latch portion 128*c* located to be engageable with the land 98 on the upper first arm portion 80*a* of the bell crank lever 80. When the bell crank lever 80 is rotated about the center axis of the shaft 82 into the second angular position, viz., the counter-clockwise extreme rotational position thereof against the force of the tension spring 146 with the eccentric cam 112 contacted by the cam follower roller 108 at the vertex $P_1$ of its higher cam lobe portion as shown in FIG. 1, the edge 128*d* of the latch portion 128*c* of the clamping member 128 is slightly spaced apart from the previously mentioned surface portion 102 of the land 98. When the eccentric cam 112 is further rotated about the center axis of the cam shaft 114 and the vertex $P_1$ of the higher cam lobe portion thereof is moved past the cam follower roller 108, the bell crank lever 80 is forced to turn clockwise in the drawings about the center axis of the shaft 82 from the second angular position illustrated in FIG. 1 by the force of the tension spring 146 until the land 98 on the bell crank lever 80 receives the edge 128*d* of the latch portion 128*c* of the clamping member 128 on its surface portion 102 as shown in FIG. 5. The angular portion of the bell crank lever 80 thus achieved when the land 98 has its surface portion 102 received on the edge 128*d* of the latch portion 128*c* of the clamping member 128 is herein referred to an allowance angular position of the bell crank lever 80 about the center axis of the shaft 82. When the clamping member 128 is held in the angular position having the edge 128*d* of its latch portion 128*c* located to be engageable with the surface portion 102 of the land 98, the bell crank lever 80 is slightly oscillated about the center axis of the shaft 82 between the second angular position and the above mentioned allowance angular position thereof as the eccentric cam 112 is rotated into and out of the angular position having the higher lobe portion contacted at its vertex $P_1$ with the cam follower roller 108 on the bell crank lever 80**.

When the bell crank lever 80 is thus rotated into the second angular position thereof, the cam actuating member 84 extending generally downwardly from the leading end of the upper first arm portion **80*a* of the bell crank lever 80 is moved into the uppermost position thereof and has one of the pins 50 on the lobular cam 44 received in the notch 90 of its hook portion 88. When the lobular cam 44 is thus held in an angular position having one of the pins 50 received in the notch 90 of the hook portion 88 of the cam actuating member 84, one of the remaining pins 50 is received on the lateral edge portion 144*b* of the lever 144 of the first cam retaining means 36 and at the same time one of the still remaining pins 50 is captured in the notch 152*a* of the lever 152 of the second cam retaining means 52, as illustrated in FIG. 1. The cam 44 is therefore locked in the above mentioned angular position and is prevented from being rotated in either direction about the center axis of the shaft 42 even when the bell crank lever 80 is rotated about the center axis of the shaft 82 clockwise of the drawings into the above mentioned allowance angular position by the force of the tension spring 146 so that the cam actuating member 84 is slightly moved downwardly from the uppermost position thereof and accordingly has the notch 90 slightly disengaged from the pin 50 which has been received in the notch 90 When the bell crank lever 80 is being moved between the second and allowance angular positions about the center axis of the shaft 82 as above described, the hook portion 88 of the cam actuating member 84 is located short of the lever 144 of the first cam acutating means 36 so that the curved notch portion 144*d* of the lever 144 is kept disengaged from the rounded projection 94 of the hook portion 88 of the cam actuating member 84 as shown in FIG. 1 even though the lever 144 is urged by the tension spring 146 toward an angular position to receive the rounded projection 94 in the notch portion 144*d*** thereof.

Figure 3:
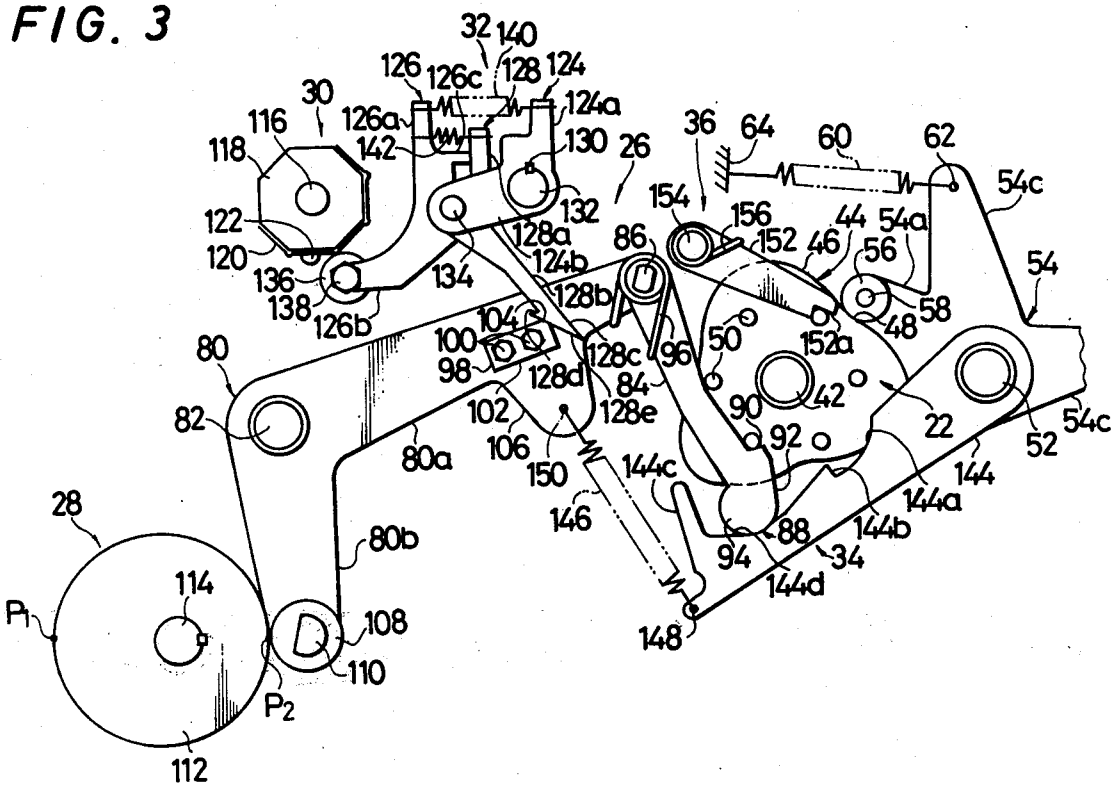

As the sprocket wheel 118 of the pattern card arrangement 30 is further rotated about the center axis of the shaft 116 and has the peg 122 contacted by the roller 136 on the rocking member 126 as illustrated in FIG. 2, the roller 136 is raised over the shaft 116 so that the rocking member 126 is rotated about the center axis of the pivotal pin 134 counter-clockwise of the drawings from the upright first angular position into the inclined second angular position against the force of the tension spring 140. If, under these conditions, the eccentric cam 112 happens to have such an angular position having its lower cam lobe portion rolling on the cam follower roller 136 or its higher cam lobe portion rolling on the cam follower roller 136 at a point anterior or posterior to the vertex of the higher lobe portion, the bell crank lever 80 is held in the allowance angular position thereof and has the land 98 located to have its surface portion 102 closely received on the edge **128*d* of the latch portion 128*c* of the clamping member 128 by the force of the tension spring 146. The clamping member 128 is thus maintained in situ against the force of the tension spring 142 due to the frictional force established between the surface portion 102 of the land 98 and the edge 128*d* of the latch portion 128*c* of the clamping member 128 and has its upper first arm portion 128*a* disengaged from the projection 126*c* of the first arm portion 126*a* of the rocking member 126 against the force of the tension spring 142. It is, thus, important that the tension spring 142 be selected so that the force thereof is overcome by the frictional force produced between the land 98 and the latch portion 128***c* of the clamping member 128 when the latch portion 128*c* is forced against the surface portion 102 of the land 98 by the force of the tension spring 146. When the eccentric cam 112 then reaches an angular position having the vertex $P_1$ of its higher cam lobe portion contacted by the cam follower roller 136, the bell crank lever 80 is rotated about the center axis of the shaft 82 into the second angular position thereof and has the land 98 located to have its surface portion 102 disengaged from the edge 128*d* of the latch portion 128*c* of the clamping member 128, which is accordingly allowed to turn counter-clockwise of the drawings about the center axis of the pivotal pin 122 by the force of the tension spring 142 until the upper first arm portion 128*a* thereof is for a second time brought into abutting engagement with the projection 126*c* of the upper first arm portion 126*a* the rocking member 126 which is held in the inclined second angular position, as shown in FIG. 2. The bell crank lever 80 is now permitted to oscillate between the first and second angular positions thereof about the center axis of the shaft 82 as the eccentric cam 112 is rotated about the center axis of the cam shaft 114. As the bell crank lever 80 is thus oscillated between the first and second angular positions thereof, the cam actuating member 84 connected to the upper first arm portion 80*a* of the bell crank lever 80 is moved between the lowermost and uppermost positions, respectively, thereof. When the bell crank lever 80 is turned clockwise of the drawings from the second angular position past the allowance angular position thereof, the cam actuating member 84 is moved downwardly from the uppermost position thereof sidewise to the cam shaft 42 carrying the lobular cam 44. When the cam actuating member 84 is thus moved downwardly from the uppermost position thereof, the notch 90 of its hook portion 88 is disengaged from the pin 50 which has been received in the notch 90 and the hook portion 88 has its guide surface 92 in sliding contact with the pin 50 which is located posterior to the pin 50 which has been caught in the notch 90. As the cam actuating member 84 is moved closer to the lowermost position thereof, the hook portion 88 thereof has its rounded projection 94 brought into abutting engagement with the notch portion 144*a* of the elongated lever 144 of the first cam retaining means 34 as illustrated in FIG. 2 and forces the lever 144 downwardly. The lever 144 is thus caused to turn counter-clockwise in FIG. 2 against the force of the tension spring 146 which has been slackened by the clockwise rotation of the bell crank lever 80 toward the first angular position thereof. When the bell crank lever 80 reaches the first angular position thereof and accordingly the cam actuating member 84 reaches the lowermost position thereof, the lever 144 of the first cam retaining means 34 is rotated about the center axis of the shaft 52 into an angular position having its lateral edge portion 114*b* disengaged from the pin 50 which has been received therein and makes the cam 44 rotatable clockwise in the drawings about the center axis of the cam shaft 42. When the cam actuating member 84 is in the lowermost position thereof, the hook portion 88 thereof has captured in its notch 90 the pin posterior to the pin 50 previously caught in the notch 90 as will be seen from FIG. 3. As the bell crank lever 80 is rotated counter-clockwise from the first angular position about the center axis of the shaft 82 against the force of the tension spring 146, the cam actuating member 84 is moved back upwardly from the lowermost position so that the pin 50 captured in the notch 90 of the hook portion 88 of the cam actuating member 84 is moved upwardly and causes the cam 44 to turn clockwise in the drawings from about the center axis of the cam shaft 42. The cam 44 is in this fashion rotated through 60° from its initial angular position about the center axis of the cam shaft 42 when the bell crank lever 80 makes one oscillatory motion about the center axis of the shaft 82 and accordingly the cam actuating member 84 makes one reciprocating motion. When the bell crank lever 80 is being moved back toward the second angular position about the center axis of the shaft 82 and accordingly the cam actuating member 84 is being moved back toward the uppermost position thereof, the hook portion 88 of the cam actuating member 84 has its rounded projection 94 disengaged from the notch portion 144*d* of the elongated lever 144, which is therefore allowed to turn about the center axis of the shaft 52 toward its initial angular position by the force of the tension spring 146 so that the pin 50 posterior to the pin 50 previously received on the lateral edge portion 144*b* of the lever 144 slides on the guide surface portion 144*a* of the lever 144 as will be seen from FIG. 4. When the bell crank lever 80 reaches the second angular position thereof about the center axis of the shaft 82, the lever 144 resumes its initial angular position about the center axis of the shaft 52 and has received on its lateral edge portion 144*b* the pin 50 newly engaged by the lever 144 so that the cam 44 is retained in the angular position newly reached. By the time the bell crank lever 80 reaches the first angular position thereof as above described, the sprocket wheel 118 of the pattern card arrangement 30 is further rotated about the center axis of the shaft 116 and has the leg 122 moved out of the position engaged by the roller 136 on the rocking member 126. The rocking member 126 is therefore allowed to rotate clockwise of the drawings back into the upright first angular position about the center axis of the pivotal pin 134 by the force of the tension spring 140 so that the clamping member 128 having its first arm portion 128*a* held in contact with the projection 126*c* of the first arm portion 126*a* of the rocking member 126 is caused to turn clockwise of the drawings about the pivotal pin 134 together with the rocking member 126 and restores its initial angular position having the latch portion 128*c* located to be engageable with the land 98 on the bell crank lever 80. When the bell crank lever 80 reaches the first angular position thereof, the latch portion 128*c* of the clamping member 128 has its guide surface portion 128*e* received on the guide surface portion 104 of the land 98, as seen in FIG. 3. As the bell carnk lever 80 is rotated counterclockwise of the drawings toward the second angular position thereof about the center axis of the shaft 82 against the force of the tension spring 136, the land 98 on the bell crank lever 80 has its guide surface portion 104 in sliding contact with the guide surface 128*e* of the latch portion 128*c* of the clamping member 128 and is disengaged from the latch portion 128*c* when the bell crank lever 80 reaches the second angular position illustrated in FIG. 1. As the bell crank lever 80 is further driven to turn clockwise of the drawings from the second angular position thus reached, the land 98 on the bell crank lever 80 has its flat surface portion 102 received on the edge 128*d* of the latch portion 128*c* of the clamping member 128 as seen in FIG. 5 so that the bell crank lever 80 is locked in a condition slightly rockable about the center axis of the shaft 82 between the second angular position and the previously mentioned allowance angular position thereof as the eccentric cam 112 is driven to have its higher and lower lobe portions alternately brought into rolling contact with the cam follower roller 108 on the bell crank lever 80.

The lobular cam 44 of the cam unit 22 is in this fashion driven to rotate clockwise in the drawings through 60° about the center axis of the cam shaft 42 every time the sprocket wheel 118 of the pattern card arrangement 30 makes a full turn about the center axis of the shaft 116, viz., per eight turns of the eccentric shaft 112 about the center axis of the cam shaft 114. When the lobular cam 44 is thus rotated into an angular position having one of its bottom portions 48 in contact with the cam follower roller 56 on the bell crank lever 54 of the link mechanism 24, the bell crank lever 54 is turned into the counterclockwise extreme rotational position, viz., the previously mentioned first angular position about the center axis of the stationary shaft 52 so that the nozzle carrier 40 of the weft insertion unit 20 is moved into the lower position thereof having the first weft shooting nozzle 38 located to have its center axis aligned with the weaving shed S and flush with the warp line L as shown in FIG. 1. The pick of the weft yarn which has been detained in the first weft shooting nozzle 38 is therefore shot into the weaving shed S by a jet stream of fluid spurting out of the nozzle 38 in one cycle of operation of the loom. Upon completion of the above described weaving cycle, the healds H and H′ are driven to lower and raise the webs W and W′, respectively, of warp yarns from the positions shown in FIG. 1 into the positions shown in FIG. 5 and form a new weaving shed S′ between the webs W and W′. Another pick of weft yarn is then inserted into the new shed S′ from the weft shooting nozzle 38. When, on the other hand, the cam 44 assumes an angular position having one of its cam lobe portions 46 in contact with the cam follower roller 56, the bell crank lever 54 is held in the clockwise extreme rotational position, viz., the previously mentioned second angular position thereof so that the nozzle carrier 40 is held in the upper position thereof and has the second weft shooting nozzle 38′ located to have its center axis aligned with the weaving shed S and flush with the warp line L, as illustrated in FIG. 5. The pick of the weft yarn which has been detained in the second weft shooting nozzle 38′ is now shot into the weaving shed S in one cycle of operation of the loom. The nozzle carrier 40 is in this fashion moved between the upper and lower positions thereof relative to the weaving shed S and accordingly either of the weft yarns detained in the first and second weft shooting nozzles 38 and 38′ is selectively inserted into the weaving shed S in accordance with the signals delivered from the pattern card arrangement 30.

Figure 6:
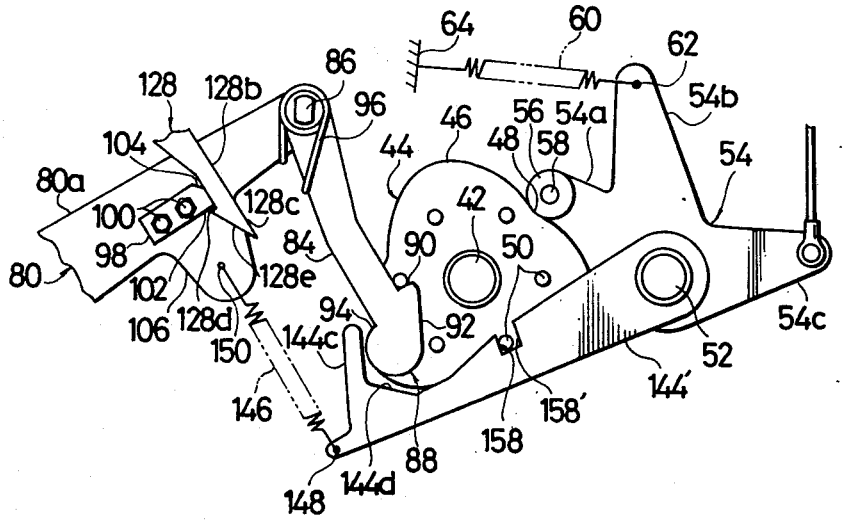
FIGS. 6 to 10 are fragmentary side elevations showing different operational conditions of a second embodiment of the apparatus according to the present invention.
Figure 7:
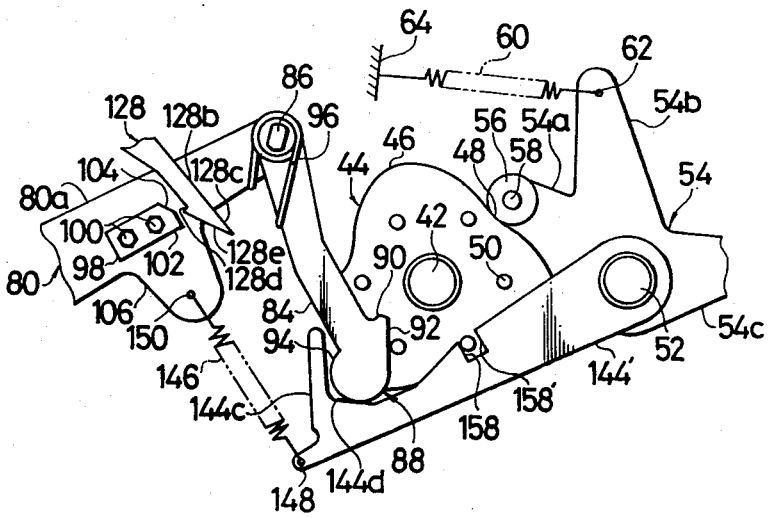
Figure 8:
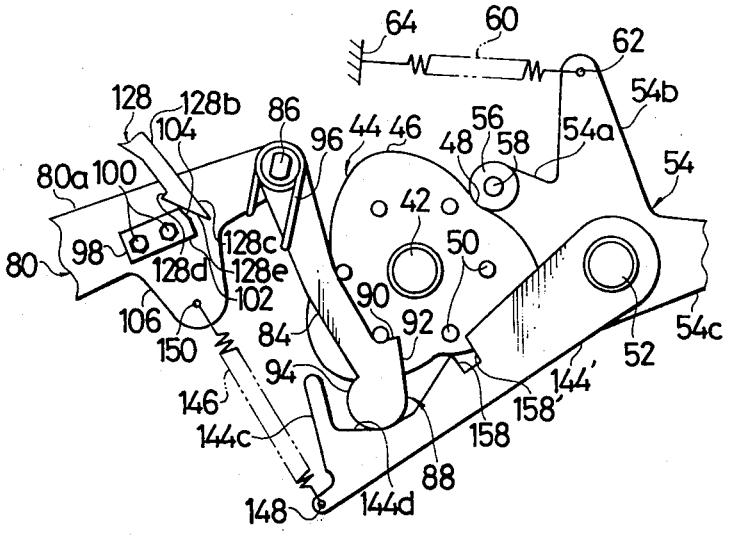
Figure 9:
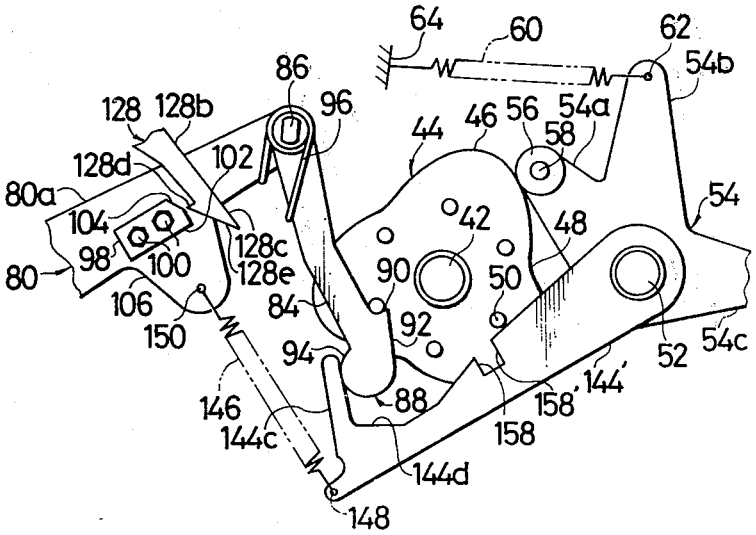
Figure 10:
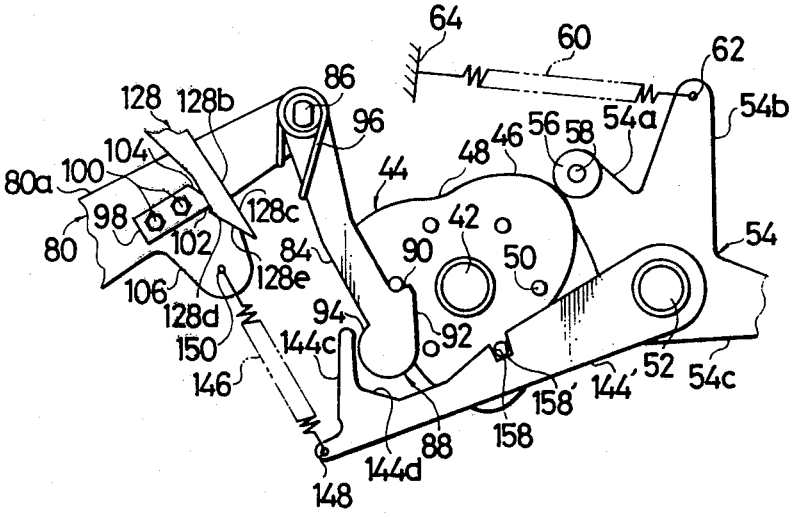

FIGS. 6 to 10 illustrate part of a second preferred embodiment of the apparatus according to the present invention. The second embodiment of the present invention is characterized by cam retaining means which is provided in lieu of the first and second cam retaining means 34 and 36 in the first embodiment of FIGS. 1 to 5 and which is thus adapted to achieve the functions of both of the first and second cam retaining means 34 and 36 of the first embodiment. The cam retaining means comprises an elongated lever 144′ which is shaped and arranged essentially similarly to its counterpart in the embodiment of FIGS. 1 to 5 and which is thus rotatable about the axis of the shaft 52 carrying the bell crank lever 54 and formed with a projection 144*c* and an edge portion 144*d* with which the cam actuating member 84 is engageable at the rounded projection 94 of its hook portion 88. Different from the cam retaining lever 144 in the embodiment of FIGS. 1 to 5, the lever 144′ of the modified cam retaining means has formed in its intermediate portion engageable with the pins 50 on the cam 44 a notch having spaced parallel edges 158 and 158′. When the lobular cam 44 is held in an angular position having one of its lobe portions 46 engaged by the cam follower roller 56 on the bell crank lever 54 as shown in FIG. 10 or its bottom portions 48 engaged by the cam follower roller 56 as shown in FIG. 6, one of the pins 50 which is located closest to the lever 144′ is captured in the notch between the parallel edges 158 and 158′ and is forced onto the bottom edge of the notch by the force of the tension spring 146 urging the lever 144′ to turn clockwise of the drawings about the center axis of the shaft 52, viz., toward the cam shaft 42. If the cam 44 is urged to turn clockwise of the drawings, viz., in the normal direction of rotation thereof about the center axis of the cam shaft 42 under these conditions, the pin 50 thus captured in the notch of the lever 144′ is forced against one edge 158 of the notch and prevents the cam 44 from being rotated in the particular direction. If, conversely, the cam 44 is urged to turn in the opposite direction about the center axis of the cam shaft 42 for some reason, then the pin 50 in the notch is forced against the other edge 158′ of the notch and prevents the cam 44 from being rotated in the particular direction. The cam 44 is in this fashion securely held in the above mentioned angular position when held at rest with the locking means 32 in locking engagement with the cam actuating means 26′. When the clamping member 128 of the locking means 32 is disengaged from the land 98 on the upper first arm portion 80*a* of the bell crank lever 80 of the cam actuating means 26 from the condition illustrated in FIG. 6 and the bell crank lever 80 is driven to turn clockwise of the drawings toward the previously mentioned first angular position thereof as illustrated in FIG. 7, the cam actuating member 84 has the guide surface 92 of its hook portion 88 in sliding contact with the pin 50 located next to the pin 50 which has been engaged by the notch 90 of the hook portion. As the bell crank lever 80 is rotated closer to the first angular position thereof, the cam actuating member 84 has the hook portion 88 brought into abutting engagement at its rounded projection 94 with the edge portion 144*d* of the cam retaining lever 144′ as shown in FIG. 7 and forces the lever 144′ to turn counter-clockwise in FIG. 7, viz., away from the cam shaft 42 about the center axis of the shaft 52 against the force of the tension spring 146 which has been slightly slackened by the clockwise rotation of the bell crank lever 80. When the bell crank lever 80 reaches the first angular position thereof and accordingly the cam actuating member 84 is moved into the lowermost position thereof, the pin 50 which has been in contact with the guide surface 92 of the hook portion 88 of the cam actuating member 84 is received in the notch 90 of the hook portion 88 by reason of the force of the spring 96 urging the cam actuating member 84 toward the cam shaft 42 and at the same time the pin 50 which has been captured in the notch of the lever 144' is withdrawn from the notch, as illustrated in FIG. 8 and makes the cam 44 to turn about the center axis of the cam shaft 42. When the bell crank lever 80 is then rotated counter-clockwise of the drawings from the first angular position thereof and accordingly the cam actuating member 84 is moved upwardly from the lowermost position thereof, the hook portion 88 of the cam actuating member 84 is disengaged from the edge portion **144*d* of the cam retaining lever 144' as shown in FIG. 9. As the cam actuating member 84 is thus moved upwardly, the cam 44 is rotated clockwise of the drawings about the center axis of the cam shaft 42 with the pin 50 received in the notch 90 of the hook portion 88 of the cam actuating member 84 so that the pin 50 located next to the pin 50 which has just been withdrawn from the notch of the lever 144' is moved closer to the notch of the lever 144' which is being turned clockwise of the drawings toward the cam shaft 42 about the center axis of the shaft 52 by the force of the tension spring 146. When the bell crank lever 80 reaches the previously mentioned allowance angular position close to the second angular position thereof, the pin 50 thus approaching the notch of the lever 144' is received in the notch and locks the cam 44 in the angular position having one of its lobe portions 46 contacted by the roller 56 on the bell crank level 54 as illustrated in FIG. 10**.

While the cam unit 22 of each of the embodiments has been described and shown as comprising only one cam, this is merely for the purpose of illustration and, for this reason, the cam means forming part of the apparatus according to the present invention may comprise two or more cams depending upon the number of the weft yarns to be used. If two or more cams are thus used, each of the cam follower roller 56, bell crank lever 54, cam actuating means 26, pattern card arrangement 30, locking means 32, and first and second cam retaining means 34 and 36 or cam retaining means 34 must be provided in a number equal to the number of the cams. Although, furthermore, the apparatus according to the present invention has been described and shown to be utilized for the selective insertion of weft yarns into the weaving shed of a loom, such an apparatus may be used for the control of the weft drawing-off and measuring mechanism and/or the weft retaining mechanism of the loom, if desired.

What is claimed is:

1. An apparatus for selectively inserting weft yarns into the shed in a weaving loom, comprising, in combination, a weft insertion unit including a plurality of weft shooting members each movable into a position aligned in use with a shed of a loom, weft selector cam means including at least one lobular cam rotatable about a fixed axis and formed with a plurality of cam lobe portions substantially equiangularly spaced apart from each other across bottom portions about said axis and having substantially equal radii from the axis, said bottom portions having from said axis substantially equal radii smaller than said radii of said cam lobe portions, a link mechanism operatively connecting said cam to said weft insertion unit for moving one of said weft shooting members into the position aligned with said shed when engaging one of said cam lobe portions and another weft shooting member into said position when engaging one of said bottom portions of said cam, cam actuating means operative to drive said cam to turn in a predetermined direction about said axis thereof from an angular position having one of its cam lobe portions engaged by said link mechanism into an angular position having one of its bottom portions engaged by the link mechanism or from the latter angular position into the former in each cycle of operation of the loom, weft selector signal supply means storing signals representative of a predetermined schedule in accordance with which the weft yarns are to be selectively inserted into said shed, locking means responsive to the signals delivered from said signal supply means for locking said cam actuating means in a condition inoperative to drive said cam in response to one signal from the signal supply means and releasing the cam actuating means from the inoperative condition in response to another signal from the signal supply means, cam retaining means engageable with said cam means for holding said cam in any of said angular positions of the cam when said locking means is in locking engagement with said cam actuating means, and the cam retaining means being disengaged from the cam when the cam is being rotated from one of the angular positions thereof into another.

2. An apparatus as set forth in claim 1, in which said cam means further comprises pins projecting from one end face of said cam substantially in parallel with said fixed axis and arranged substantially in symmetry about the axis, the number of said pins doubling the number of said lobe portions of said cam, said cam actuating means being engageable with said pins and movable with respect to said fixed axis for turning each of the pins through an angle equal to the central angle between every neighboring two of the pins about said fixed axis and thereby driving said cam to rotate through said angle about said fixed axis in each cycle of operation provided said cam actuating means is disengaged from said locking means.

3. An apparatus as set forth in claim 2, in which said cam actuating means comprises at least one bell crank lever rotatable about a fixed axis substantially parallel with said axis of said cam and at least one cam actuating member which is rotatable on said bell crank lever about a fixed axis substantially parallel with the axis of rotation of said cam and which is engageable with the pins on the cam, said bell crank lever being rotatable about the axis of rotation thereof between a first angular position having said cam actuating member in a position engaging one of said pins on the cam and a second angular position having the cam actuating member in a position engaging the pin forward of said one of the pins in said direction of rotation of the cam, said bell crank lever being operative to move said pins through said angle per oscillatory motion of the bell crank lever from said first angular position to said second angular position and back from the second angular position into the first angular position thereof.

4. An apparatus as set forth in claim 3, in which said locking means comprises a clamping member rotatable about a fixed axis substantially parallel with the axis of rotation of said cam, a land on said bell crank lever and engageable with said clamping member depending upon the relative angular positions of the clamping member and said bell crank lever, said clamping member having about the axis of rotation thereof an angular position engageable with the land on said bell crank lever and being in locking engagement with the land when the clamping member is in said angular position thereof and simultaneously said bell crank lever is in an allowance angular position slightly turned away from said second angular position toward said first angular position thereof about the axis of rotation of the clamping member, a rocking member rotatable about a fixed axis coincident with the axis of rotation of said clamping member, first biasing means connected between said clamping and rocking members for urging the clamping member to turn away from said angular position thereof about the axis of rotation thereof, the biasing force of the first biasing means being variable depending upon the relative angular positions of the clamping and rocking members, said rocking member being rotatable about the axis of rotation thereof between a first angular position producing a smaller biasing force in said first biasing means and a second angular position producing a greater biasing force in the biasing means, second biasing means urging said rocking member toward said first angular position thereof, third biasing means urging said bell crank lever toward said first angular position thereof about the axis of rotation thereof, and stop means fast on said rocking member and engageable with said clamping member for preventing the rocking member from being rotated beyond said first angular position thereof by the force of said second biasing means, said stop means being in engagement with said clamping member irrespective of the angular position of the rocking member when said clamping member is disengaged from said land on said bell crank lever.

5. An apparatus as set forth in claim 4, in which said land on said bell crank lever has a surface portion engageable with said clamping member, said clamping member being in said locking engagement with said land by surface-to-surface contact with said surface portion of the land and forced against the surface portion by the force of said third biasing means when the clamping member is in said angular position thereof and simultaneously said bell crank lever is in said allowance angular position thereof, said first biasing means being selected so that said smaller biasing force thereof is overcome by the force exerted between said surface portion and said clamping member by said third biasing means.

6. Apparatus as set forth in claim 4, in which said cam retaining means comprises a cam retaining member having an angular position engageable with one of said pins on said cam and connected by said third biasing means to said bell crank lever for being urged toward said angular position thereof, said cam retaining member being operative to prevent said cam from being rotated in said predetermined direction about said axis of rotation thereof when held in said angular position thereof, said cam actuating member being engageable with said cam retaining member for moving the cam retaining member out of said angular position thereof for permitting said cam to turn in said predetermined direction about the axis of rotation thereof when said bell crank lever is moved into said first angular position thereof against the force of said third biasing means.

7. An apparatus as set forth in claim 6, in which said cam retaining means further comprises a cam retaining member having an angular position engageable with one of said pins on said cam and urged toward said angular position thereof for being operative to prevent said cam from being rotated about the axis of rotation thereof in the direction opposite to said predetermined direction when held in said angular position thereof.

8. An apparatus as set forth in claim 6, in which said cam retaining means comprises a cam retaining member having an angular position engageable with said pins on said cam and connected by said third biasing means to said bell crank lever for being urged toward said angular position thereof, said cam retaining member being operative to prevent said cam from being rotated in both directions about the axis of rotation thereof when held in said angular position thereof, said cam actuating member being engageable with said cam retaining member for moving the cam retaining member out of said angular position thereof when said bell crank lever is moved into said first angular position thereof against the force of said third biasing means.

9. An apparatus as set forth in claim 8, in which said cam retaining member is formed with a notch having two spaced edges, said cam retaining member being receivable one of said pins between said edges for preventing said cam from rotating in one direction about the axis thereof with the pin received on one of said edges and in the other direction about the axis thereof with the pin received on the other of said edges when the cam retaining member is in said angular position thereof.

* * * * *